US006965081B2

(12) United States Patent
Eves et al.

(10) Patent No.: US 6,965,081 B2
(45) Date of Patent: Nov. 15, 2005

(54) CABLE

(75) Inventors: David A. Eves, Crawley (GB); Philippa C. Wagner, London (GB)

(73) Assignee: Koninklijke Philips Electronics, N.V., Eindhoven (NL)

( * ) Notice: Subject to any disclaimer, the term of this patent is extended or adjusted under 35 U.S.C. 154(b) by 52 days.

(21) Appl. No.: 10/155,320

(22) Filed: May 24, 2002

(65) Prior Publication Data

US 2003/0056969 A1 Mar. 27, 2003

(30) Foreign Application Priority Data

Jun. 19, 2001 (GB) ..... 0114976

(51) Int. Cl.[7] ..... H01B 7/18
(52) U.S. Cl. ..... 174/105 R; 174/122 R
(58) Field of Search ..... 174/105 R, 107, 174/108, 109, 113 R, 121 R, 122 R

(56) References Cited

U.S. PATENT DOCUMENTS

| | | | | |
|---|---|---|---|---|
| 1,523,051 | A * | 1/1925 | Carpenter et al. | 174/105 R |
| 2,376,101 | A * | 5/1945 | Tyzzer | 333/12 |
| 2,529,914 | A * | 11/1950 | Challenner | 338/214 |
| 2,863,032 | A * | 12/1958 | Morris | 174/109 |
| 3,286,022 | A * | 11/1966 | Hvizd, Jr. | 174/105 R |
| 4,200,126 | A * | 4/1980 | Fish | 138/143 |
| 4,491,939 | A | 1/1985 | Carpenter | 367/20 |
| 4,677,256 | A | 6/1987 | Bauer et al. | 174/116 |
| 4,819,914 | A * | 4/1989 | Moore | 256/10 |
| 5,061,823 | A * | 10/1991 | Carroll | 174/105 R |
| 5,298,682 | A * | 3/1994 | Salz | 174/105 R |
| 5,485,774 | A | 1/1996 | Osborne | 87/6 |
| 6,121,547 | A | 9/2000 | Harada | 174/36 |
| 2001/0032732 | A1 * | 10/2001 | Fujino et al. | 174/106 R |

FOREIGN PATENT DOCUMENTS

| | | |
|---|---|---|
| DE | 647039 C | 6/1937 |
| GB | 594459 A | 11/1947 |

* cited by examiner

*Primary Examiner*—Chau N. Nguyen

(57) ABSTRACT

An electrical cable of all textile construction includes a first conductor of conductive textile material, a first insulator of braided insulating textile material, a second conductor of braided conductive textile material and a second insulator of braided insulating textile material. Such a cable, through being of an all textile construction makes it particularly suitable for incorporation in items such as garments, fashion accessories, upholstered article and other soft furnishings as it can be made very flexible, soft to the touch and of a required color. Furthermore, by making the cables using textile materials that have been developed for use in garments, the cables are capable of being subjected to standard garment care techniques such as machine washing in the home or dry cleaning. This means items, such as garments, that include these cables can be placed in the washing machine for cleaning, with no added risk to the wire, garment or washing machine.

13 Claims, 2 Drawing Sheets

CABLE

FIELD OF THE INVENTION

The present invention relates to electrical cables and more particularly to electrical cables suitable for incorporation into apparel, clothing accessories, soft furnishings, upholstered items and other articles.

BACKGROUND OF THE INVENTION

A wide variety of electrical cables are available on the market and they range from straightforward constructions having a single conductor through to more complex constructions having, for example, multiple conductors, a coaxial conductor arrangement or shielded subsets of conductors. Some cables are intended for use in quite specific applications and when designing such cables a number of factors need to be taken into consideration. These include the characteristics of the electrical current or signal that the cable needs to convey and the intended environmental conditions that the cable will need to operate within. Other factors relate to the more mechanical aspects of the cable such as how flexible it needs to be, whether it should be compatible with particular post-manufacture processes and even it's visual appearance and feel.

Traditionally, the electronics industry and the clothing industry have produced products in different fields and have remained apart. More recently, a joint project between Philips Electronics and Levi Strauss® culminated in the launch of the Levi's ICD+jacket range in 2000. The jackets of this range were designed to carry a mobile telecommunications device, portable audio device (an MP3 player), user headphones and a microphone. The jackets were also provided with wiring to connect these devices together and a user keypad for controlling the devices and providing added functionality in terms of synchronising device operation.

The Levi's ICD+jackets are an example of non-rigid items which require a component part, in this case an electrical cable, more generally associated with the electrical or electronics industry than with the clothing industry. However, while such cable or cabling must be able to perform the function of conveying electrical current or signals, it's use in a garment requires the cable to have other characteristics. Such a cable should be flexible enough to bend with the garment during use and be sufficiently discrete such that even when the cable is located beneath the exterior surface of the garment, the presence of the cable does not detract from the appearance or hang of the garment. Furthermore, the presence of the cable should not cause discomfort to the person using the garment. Some of these characteristics are also desirable when cabling is fitted to other items such as clothing accessories, soft furnishings or other fabric based 'soft' items.

Some known attempts to provide electrical current or signal carrying conductors in fabric based articles have been based on standard 'flat' textile structures of woven or knitted layers. The conductors are provided by including conductive yarns during the knitting or weaving process or by applying conductive layers to the yarn at a later stage. These approaches lead to arrangements occupying relatively large surface areas, especially when there is a need to separate multiple conductors, and difficulties with reliably insulating and isolating selected parts of the circuitry that the conductors form. It can also be difficult to provide shielding for these arrangements, as is often required to minimise electromagnetic emission or the effects of external interference.

It is an object of the present invention to provide an electrical cable which is suitable for including in items such as garments, clothing accessories, soft furnishings, upholstered articles and other such 'soft' items.

SUMMARY OF THE INVENTION

In accordance with the present invention there is provided a cable including at least one textile electrical conductor. Optionally, the at least one textile electrical conductor is of a braided construction. Furthermore, the cable may include at least one textile electrical insulator. Optionally, the at least one textile electrical insulator is of a braided construction.

Thus, by providing the conductors of the cable in the form of a textile rather than the more conventional all metallic conductors, it is possible to provide a cable made entirely from textile fibres. The term textile is taken here to mean a fibre or filament material, of a type which is generally, although not essentially, recognised as being suitable for producing a textile yarn. Such yarns are usually intended for use in a knitting, weaving, embroidering or braiding process.

In one particular arrangement, the cable is arranged with a central core of said textile electrical conductor, an insulating layer of said textile electrical insulator surrounding said central core and a conducting layer of said textile electrical conductor surrounding said insulating layer. Hence a shielded cable can be provided having a signal carrying conductor formed by the central core and a shielding provided by the conducting layer.

Optionally, one or more textile electrical conductor includes fibre or filament conductive material. In this case, one or more textile electrical conductor may further include fibre or filament insulative material. Optionally, the fibre or filament conductive material is provided in the form of one or more yarns.

Optionally, textile electrical insulator includes fibre or filament insulative material. The fibre or filament insulative material may be provided in the form of one or more yarns.

These and other aspects of the present invention appear in the appended claims which are incorporated herein by reference and to which the reader is now referred.

The present invention will now be described by way of example with reference to the Figures of the accompanying drawings in which.

Figure 1:
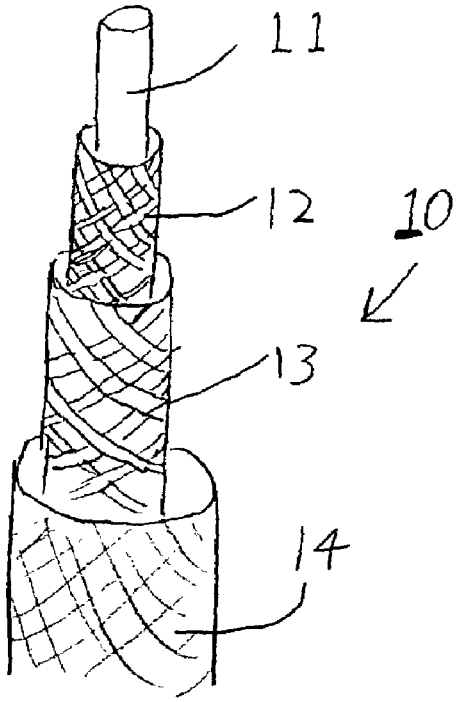
FIG. 1 shows a perspective view of a first embodiment of a portion of a cable made in accordance with the present invention.

It should be noted that the drawings are diagrammatic and not drawn to scale. Relative dimensions and proportions of parts of the Figures have been shown exaggerated or reduced in size for the sake of clarity and convenience in the drawings. The same reference signs are generally used to refer to corresponding or similar features in the different embodiments.

DETAILED DESCRIPTION OF THE PRIMARY EMBODIMENT

Referring to FIG. 1, cable 10 includes a first electrical conductor 11 in the form of a single core of textile material made from Lurex® thread. Lurex is the trade name for a commercially available material established in the garment construction industry. Lurex is composed of a nylon thread that is coated with a conductor, in this case coated with copper. The first electrical conductor could also be of carbon fibre. Surrounding the core 11 is a first electrical insulator 12 having a braided construction. This is electrically insulative due to the insulating properties of the material or materials used in the braiding process. Suitable materials Include nylon, polyamide, acetate, cotton, wool. The braided insulator 12 may be produced from just one type of yarn or a number of different yarns and by varying the proportions of such yarns with respect to each other and the braiding pattern used, the characteristics of the braiding may be adjusted as will be appreciated by the person skilled in the art. The characteristics of the braiding may be adjusted to suit the intended application of the cable. For example, nylon yarns may be included for their strength, cotton for it's flexibility and polyamide yarns for their suitability of accepting a coating material. Surrounding the first insulator 12 is a second electrical conductor 13 having a braided construction. This is electrically conductive due to the conductive properties of the material or materials used in the braiding process. Suitable materials include coated textiles such as Lurex or any other electrically conductive textile yarn. The braided conductor 12 may be produced from just one type of yarn or a number of different yarns and by varying the proportions of such yarns with respect to each other and the braiding pattern used, the characteristics of the braiding may be adjusted as will be appreciated by the person skilled In the art. The characteristics of the braiding may be adjusted to suit the intended application of the cable.

The first conductor 11 may itself be of a single filament, multi-filament or braided construction.

Surrounding the second electrical conductor 13 is a second electrical insulator 14, also having a braided construction. This is electrically insulative due to the insulative properties of the materials used in the braiding process, as has already been discussed above in respect of the first electrical insulator 12. The braiding of the second insulator 14 may be the same as that of the first insulator 12 or differ in one or more respects, such as the yarn or yarns used in the braiding process or through the use of a different braiding pattern.

Subsequent layers of braided conductors or insulators may be added to the cable described above to form a cable having multiple conductors, as will be appreciated by the person skilled in the art.

In the case of the outermost cable braiding, the yarns selected for the braiding process and the braiding pattern used may be selected to tailor the required feel and look of the cable. This is especially important where the cables are included in an item such as a garment or soft furnishing if the cable can be seen or handled. For example yarn materials used for the outermost braiding can be chosen to give the cable a particular colour or texture. Furthermore, by including a material which is capable of accepting a surface coating, such as a dye, it is possible to use one type of cable in each of a number of products that will have a different colour, and the cable adopts the required colour during a dying process. In some circumstances the cable may be dyed along with other parts of the article it is incorporated in. Thus, it is not necessarily to produce a number of cables having a different colour where the cable is to form part of an item which is to undergo a dying process.

Figure 2:
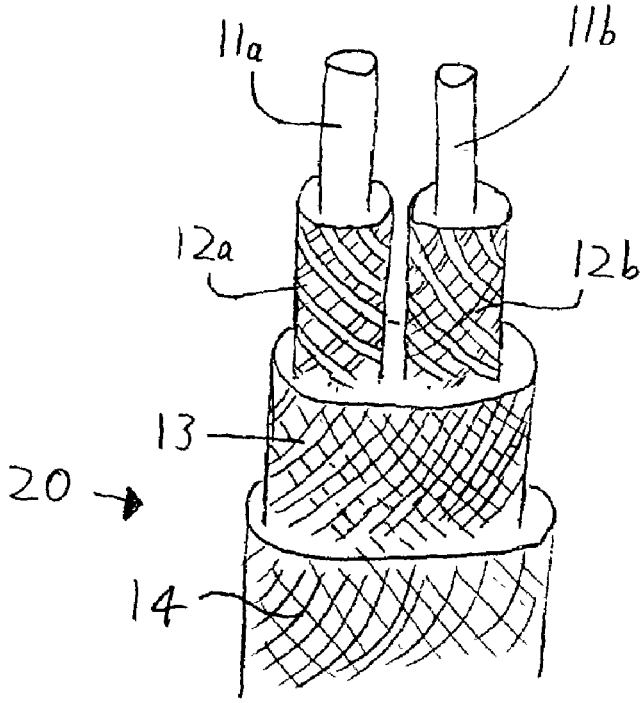
FIG. 2 shows a perspective view of a first aspect of a second embodiment of a portion of cable made in accordance with the present invention.

The cable shown in FIG. 2 is a second embodiment which differs from the cable of FIG. 1 as will now be described. The cable of FIG. 2 is provided with two first electrical conductors 11*a* and 11*b* instead of one first electrical conductor 11. Furthermore the cable is provided with two first electrical insulators 12*a* and 12*b* instead of one first electrical insulator 12. Each of the two first electrical conductors 11*a* and 11*b* is surrounded by one of the two first electrical insulators 12*a* and 12*b* respectively. Surrounding the two first electrical insulators 12*a* and 12*b* is second electrical conductor 13 having a braided construction, as has already been described with respect to the first embodiment. Furthermore, surrounding the second electrical conductor 13 is the second electrical insulator 14, as has already been described with respect to the first embodiment.

Figure 3:
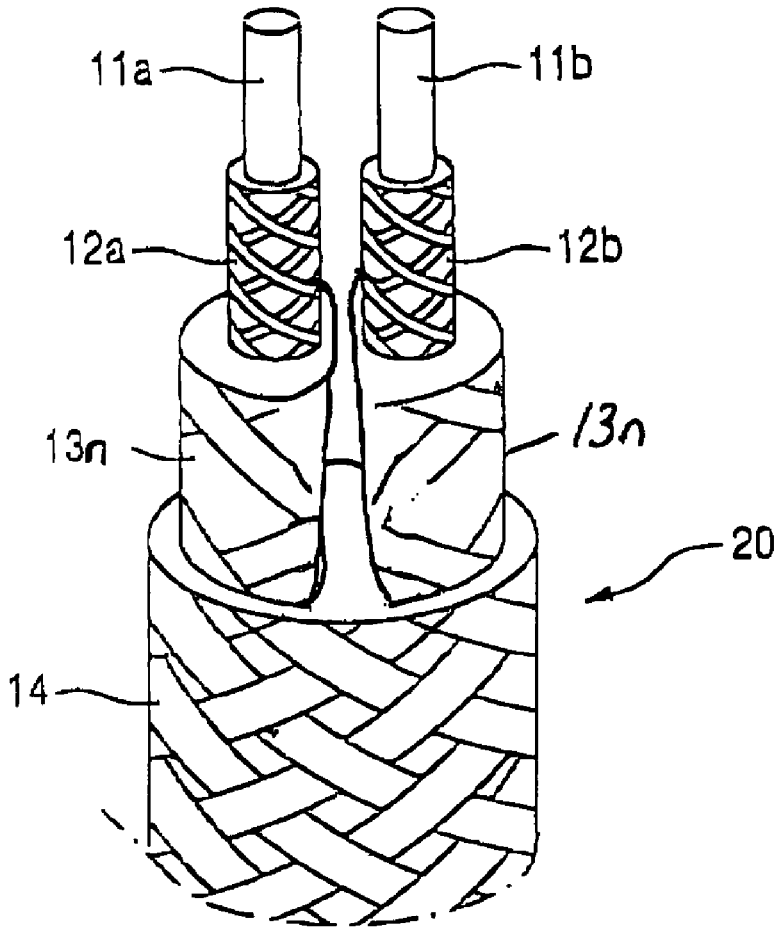
FIG. 3 shows a perspective view of a second aspect of a second embodiment of a portion of cable made in accordance with the present invention.

Although a cable arrangement having two first conductors 11*a* and 11*b* has been described, it will be appreciated that it is possible to have a cable arrangement having any number of first conductors 11*a*, 11*b*, 11*c*, . . . 11*n*, each surrounded by an associated first insulator 12*a*, 12*b*, 12*c*, . . . 12*n*. Furthermore, although the first conductors 11*n* share a common surrounding second conductor 13, each of the first conductors 11*n* could be provided with their own individual associated surrounding second conductor 13*n* (as shown in FIG. 3), as will be appreciated by the person skilled in the art.

Although two embodiments have been described in detail, this is not to be construed as a limitation to the invention and it will be appreciated by the person skilled in the art that a large variety of different cable arrangements may be produced in terms of the number of conductors and their relationship with other conductors and the insulators. The materials used for the first conductors 11 may be mono filament or multi filament or arranged to form a braid. The yarns used in the braiding process to form any one of the conducting or insulating braids may be mono filament or multi filament and each yarn may comprise more than one material. Each braid may comprise more than one yarn type.

Suitable conducting materials include carbon fibre conductive polymers, or polymers otherwise having a conductive property due to their composition. Other suitable conducting materials include insulators such as polyamide coated with conductors, for example coatings of nickel, copper, aluminium, gold and sliver. Plating techniques include electroless plating. Suitable insulating materials include nylon, polyamide, acetate, cotton and wool. In fact any suitable textile materials may be used irrespective of whether they are natural or man made providing they can be processed to form the cables of the present invention.

The applicants have realised that a cable for carrying electrical current or signals can be produced entirely from textile fibres. Hence a wide range of textile cable arrangements which are equivalent to standard all-metal conductor cables can be produced. Various levels of shielding and insulation can be provided, with a varying number of conductors. Such cables, through being produced entirely from textiles using manufacturing techniques commonly associated with the textile industry, such as braiding, offer the potential of a low cost cable type that is compatible with manufacture techniques used during the construction of garments, fashion accessories, upholstery and other soft furnishings. Through selecting textile fibres commonly intended for producing cloth or fabric, the cables are capable of withstanding the usual wear and tear that textile products are exposed to. Furthermore, because many of the materials will have been developed for use in garments and the like at the outset, they will often be capable of being subjected to standard garment care techniques such as machine washing in the home or dry cleaning. This means any item, such as a garment, which includes these cables can be placed in the washing machine for cleaning, with no added risk to the wire, garment or washing machine.

The cables can be extremely soft and flexible and fastened to cloth by stitching, piping or even woven into a base cloth. Electromagnetic shielding can be achieved.

Cables made in accordance with the present invention are very robust, since the braided construction allows them to extend in length when tension is applied to them. Such extension is more readily permitted when all components of the cable are of a braided construction.

Although the first embodiments of the cables are described with the innermost core or cores being conductors, the cores may alternatively be insulators in certain arrangements. Optical fibre elements may be included in the cable.

The cable of the present invention may themselves be used as 'yarn' in a knitting or weaving process.

From reading the present disclosure, other modifications will be apparent to persons skilled in the art. Such modifications may involve other features which are already known in the design, manufacture and use of cables, garments, upholstered articles and other soft furnishings and applications thereof and which may be used instead of or in addition to features already described herein.

What is claimed is:

1. A cable comprising:

an interior, flexible conducting portion including a first textile electrical conductor comprised of a textile fiber/filament that is electrically conductive, an exterior, flexible textile electrical insulator portion, surrounding at least part of said first textile electrical conductor, said exterior textile electrical insulator portion being selected based upon a desired look and feel of said cable, a first insulating layer comprising a textile electrical insulator that surrounds said first textile electrical conductor, and a conducting layer including a second textile electrical conductor comprising a textile fiber/filament that is electrically conductive, wherein said textile fiber/filament of the second textile electrical conductor is adapted for integration in fabric-based items, said conducting layer surrounding said first insulating layer.

2. A cable in accordance with claim 1 wherein either or both the first and second textile electrical conductors comprise a braided construction.

3. A cable in accordance with claim 1 wherein the textile electrical insulator comprises a braided construction.

4. A cable in accordance with claim 1 further comprising a second insulating layer, wherein the first insulating layer, the conducting layer and the second insulating layer are concentrically arranged around the interior, flexible conducting layer, respectively.

5. A cable in accordance with claim 4 wherein the interior, flexible conducting layer, the first insulating layer, the conducting layer, and the second insulating layer are adapted for integration in a stitching, piping, knitting or weaving process by being provided in the form of one or more yarns.

6. A cable in accordance with claim 4 further comprising a plurality of additional conducting layers and insulating layers alternately arranged around the second insulating layer.

7. A cable in accordance with claim 1 wherein the fiber/filament is adapted for integration in a stitching, piping, knitting or weaving process by being provided in the form of one or more yarns.

8. A cable in accordance with claim 1 wherein the exterior, flexible textile electrical insulator portion comprises a fiber or filament insulative material.

9. A cable in accordance with claim 8 wherein the fiber or filament insulative material is adapted for integration in a yarn for fabric-based items by being provided in the form of one of more yarns.

10. A cable in accordance with claim 1 wherein the exterior, flexible textile electrical insulator portion comprises at least a proportion of insulative fiber/filament material adapted for accepting a coating so as to affect its perceived visible color.

11. A method of producing a cable having the technical features of claim 1.

12. A method of producing an electrical cable comprising the steps of:

providing a flexible interior electrical conductor in the form of a textile;

providing a flexible exterior electrical insulator in the form of a textile;

providing at least one flexible intermediate insulative layer comprising a textile electrical insulator for surrounding the interior electrical conductor; and providing at least one flexible intermediate conducting layer including textile electrical conductor comprising an electrically conductive fiber/filament, wherein the interior electrical conductor, any intermediate insulative or conducting layer, and the exterior insulator are arranged with respect to each other to form a cable and selected based upon a desired look and feel of said cable.

13. A method in accordance wit claim 12 wherein the least one intermediate insulative layer, the at least one intermediate conducting layer, exterior textile electrical insulator, or any combination of the same are arranged to substantially surround the interior electrical conductor.

* * * * *